United States Patent [19]

Werber

[11] 4,242,800

[45] Jan. 6, 1981

[54] GARMENT DESIGNING AID

[76] Inventor: Fred W. K. R. Werber, 29 Schaumans-kamp, Reinbeck, Hamburg, Fed. Rep. of Germany

[21] Appl. No.: 16,669

[22] Filed: Mar. 1, 1979

Related U.S. Application Data

[62] Division of Ser. No. 853,668, Nov. 21, 1977, Pat. No. 4,156,969.

[30] Foreign Application Priority Data

Mar. 9, 1977 [ZA] South Africa ..... 77/1434
Nov. 19, 1976 [GB] United Kingdom ..... 48456/76

[51] Int. Cl.[3] ..... A41H 3/015
[52] U.S. Cl. ..... 33/14
[58] Field of Search ..... 33/14, 15

[56] References Cited

U.S. PATENT DOCUMENTS 690,214 12/1901 Wilson ..... 33/14
1,175,996 3/1916 Rothenberger et al. ..... 33/14

*Primary Examiner*—Charles E. Phillips
*Attorney, Agent, or Firm*—Ladas & parry

[57] ABSTRACT

A garment design aid for assisting a person in providing a pattern for a garment, the design aid including a main pattern template defining a hip region of the garment and including a hip adjusting means comprising: a first member that is pivotally attached at one end to the pattern template member on one side of the hip region, has at its other end a slot-extending circumferentially of said pivotal attachment that will allow movement of said first member across said main pattern template and has a suitably curved side edge; a second member that is pivotally attached at one end to the first member intermediate the first member's ends adjacent the hip region, has a substantially outwardly extending slot transverse to the slot in said first member and has a suitably curved side edge which cooperates with the side edge of the first member to define a variable hip profile of the garment; a pin fast with the main pattern template member and extending through the slots in the first and second members such that pivoting of the first member causes the second member to pivot about its attachment to said first member and to slide along said transfer slot in a suitable manner; and a securing means for securing the first and second members in a desired configuration.

1 Claim, 2 Drawing Figures

GARMENT DESIGNING AID

This is a division of application Ser. No. 853,668 filed Nov. 21, 1977 now U.S. Pat. No. 4,156,969.

This invention relates to a pattern designing aid. More particularly, the invention relates to an aid for assisting a person in designing garments generally, and more specifically for bodices, pants and skirts.

Conventionally, women who do their own sewing and are unable to design clothing rely on purchased patterns for making dresses. These patterns come in fixed sizes predetermined by statistics and do not cater for in-between sizes and items such as differences in bust, waist, neck and arm measurements.

There is, of course, also a system by means of which small patterns may be enlarged to given sizes by a special kit. This system does not always suit all dressmakers since it calls for the drawing of the pattern from a series of dots.

Garments such as bodices, pants and skirts normally can be considered to consist of four panels which when joined together form the bodice, pants or skirt as the case may be. For example, with a bodice, when the four panels are joined together, they form the back and front of the bodice with arm-holes, a neck opening and a waist opening. It will be appreciated that the panels are in pairs—a front pair and a back pair. Each panel of a pair is a mirror image of the other panel of that pair. For a given garment, one thus need essentially a pattern for one front panel and a pattern for one back panel. Thereafter, the panels can be cut as mirror images of the ready cut panels.

According to the invention, there is provided a garment design aid for assisting a person in providing a pattern for a garment, the design aid including a hip dimension varying means for varying the hip dimension of the garment.

This hip dimension varying means comprises a first member pivotally attached at one end to a pattern template for the garment and a second member pivotally attached at one end to the first member intermediate the first member's ends, with the free ends of the first and second members being secured to the pattern template by means of a screw and nut, the screw passing through suitable slots in the first and second members.

The invention will now be described, by way of example, with reference to the accompanying drawings in which.

Figure 1:
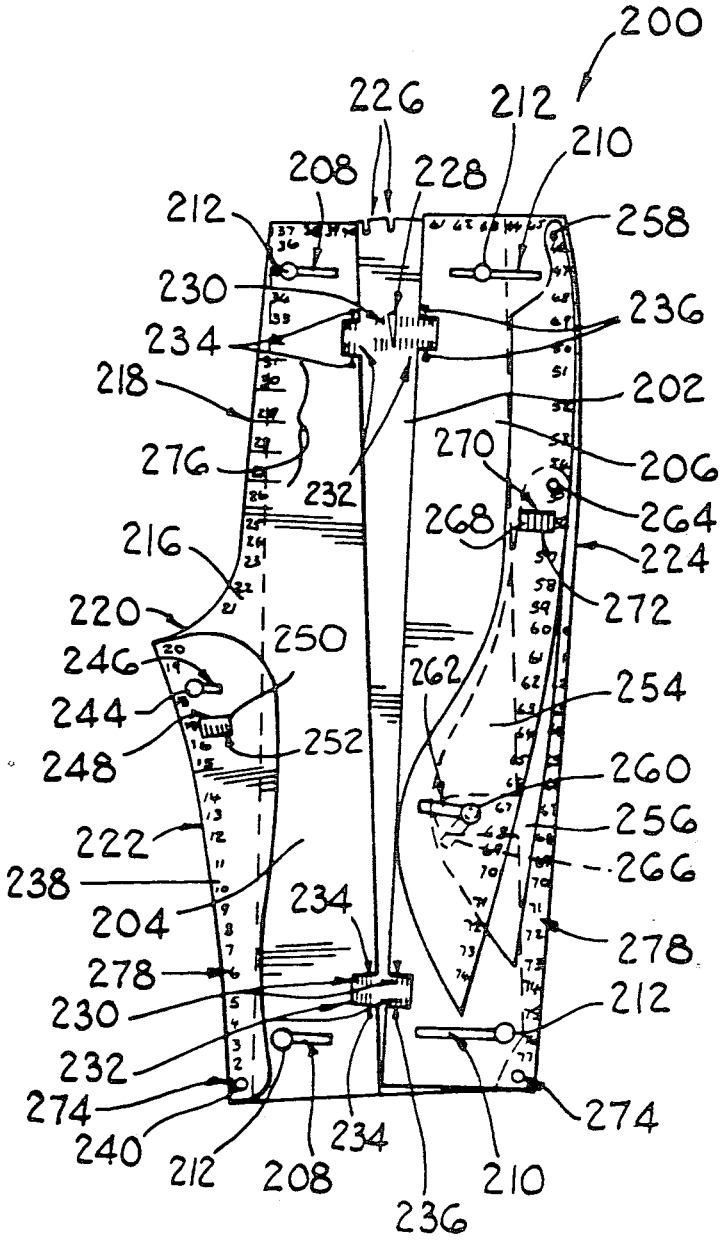
FIG. 1 shows a pants design aid in accordance with the invention.

Referring now to FIG. 1, shown therein is a pants designing aid 200. The pants designing aid 200 has a first template section 202, a second template section 204, and a third template section 206. The second template section 204 and the third template section 206 are slidably secured to the first template section 202 by means of bolts which are fast with the first template section 202 and which extend through slots 208 and 210 in the second and third template sections 204 and 206 respectively, the bolts being engaged by nuts 212. The second and third template sections 204 and 206 overlap different sides of the first template section 202. The side 214 of the second template section 204 which extends beyond the first template section 202 is shaped to define the crutch and inner leg seams of the pants. Thus, the second template section 204 has a side edge region 218 which defines the fly portion of the crutch seam, a portion 220 which defines the lower portion of the crutch seam, and a portion 222 which defines the inner leg seam. The outer edge 224 of the third template secton 206 defines the outer leg seam of the pants. Further, the upper sides of the first, second and third template sectons 202, 204 and 206 define the waist opening of the pants. Intermediate the sides of the first template section 202, and at its upper end, there are provided two notches 226 and a triangular aperture 228 which define a waist dart. Marked on the first template section 202 are two sets of size gradations. A first set 230 is utilised if the pants is to have a dart, and the other set 232 is utilised if the pants does not have a dart. In order to reference the gradations 230 and 232, pointers 234 are provided on the second template section 204 and pointers 236 are provided on the third template section 206.

The pants designing aid 200 further has a crutch depth varying member 238 which is pivotally secured at its lower end to the bottom outer corner of the second template section 204 by means of a pivot pin 240 and which varies the length of the edge portion 220 by pivotal displacement. The position of the member 238 may be adjusted by means of a bolt and nut 244 and a slot 246 in the member 238. The member 238 further has a window 248 by means of which size gradations 250 on the second template section 204 may be referenced by means of a pointer 252 on the member 238.

The hip dimension of the pants may be varied by means of two members 254 and 256. The member 254 is pivotally secured at its upper end to the upper corner of the third template section 206 by means of a pivot pin 258, the member 254 being secured in the desired pivotal position by means of a nut and bolt arrangement 260 which engages a slot 262 in the member 254. The other member 256 is pivotally secured at its upper end to the member 254, intermediate its ends, by means of a pivot pin 264. The pivot pin 264 is positioned to correspond with the hip region of the pants. The member 256 is also engaged with the nut and bolt 260 by means of a slot 266. It will be appreciated that by pivoting the member 254, the member 256 is also displaced, thereby altering the profile of the edge 224 to enlarge the hip dimension. The amount of displacement required is indicated by means of gradations 268 on the member 256 which are visible through a window 270 in the member 254 and which are referenced by means of a pointer 272.

At their lower outer corners, the second and third template sections 204 and 206 have apertures 274 by means of which a further design aid (not shown) for designing the lower leg portions of the pants, may be attached to the pants design aid 200 shown in FIG. 1.

To use the design aid 200 the second and third template sections 204 and 206 are adjusted in accordance with the required size, utilising the gradations 230 or 232 and the pointers 234 and 236. The members 238, and 254 and 256 are then adjusted if required, to provide the required crutch depth and hip size. The design aid 200 is then placed on a sheet of paper, and the outline of the upper portion of the design aid 200 drawn thereon, to provide the upper portion of the pattern. A number of gradations 276 are provided on the second template section 204 along the edge portion 218, by means of which the length of the fly portion of the crutch is varied. Thus, once the outline of the upper portion of the design aid 200 has been traced, the design aid 200 is shifted down the required amount as indicated by the gradations 276 and the rest of the outline traced to provide a pattern for the pants. If any styling variations are required, a set of numerals 278 is provided along the outer and upper sides of the second and third template sections 204 and 206. In order to make styling variations, these numerals 278 are utilised in accordance with a set of instructions, to draw various patterning lines on the pattern.

Figure 2:
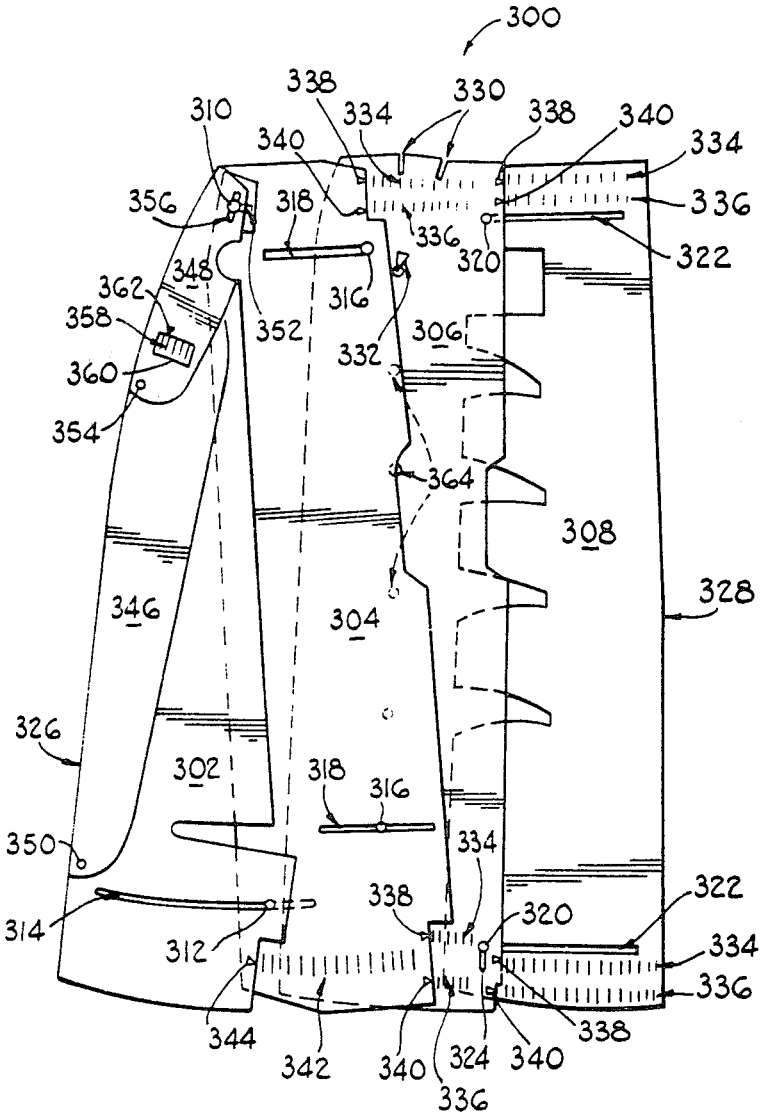
FIG. 2 shows a skirt design aid in accordance with the invention.

A skirt design aid is now described with reference to FIG. 2, the design aid being indicated by reference numeral 300. The skirt design aid 300 comprises four template sections, a first template section 302 a second template section 304, a third template section 306 and a fourth template section 308. The first template section 302 is substantially triangular in shape, and the other three template sections 304, 306 and 308 are substantially rectangular. The first template section 302 is pivotally attached at its upper apex end to the top left-hand corner of the second template section 304 by means of a pivot pin 310. The pivot pin 310 is in the form of a nut and bolt arrangement, the purpose of which will be explained below. The position of the first template section 302 relative to the second template section 304 may be varied by means of a further nut and bolt arrangement 312, the bolt being fast with the second template section 304 and being slidable in a slot 314 in the first template section 302. The third template section 306 is slidably attached to the second template section 304 in an adjustable manner, by means of nut and bolt arrangements 316 and slots 318 provided in the second template section 304. Similarly, the fourth template section 308 is slidably secured to the third template section 306 to be both linearly and pivotally displaceable, by means of nut and bolt arrangements 320 suitable slots 322 being provided in the fourth template section 308 and a slot 324 being provided in the third template section 306. The outer edges 326 and 328 of the first and fourth template sections 302 and 308 respectively define the sides of skirt panels which are utilised to form the skirt. The upper ends of the template sections define the top edge of the panels, and the bottom ends of the template sections define the bottom edge of the skirt panels. At its upper end, the third template section 306 has two notches 330 and a triangular aperture 332 which define a waist dart. On the third template section 306 and on the fourth template section 308, are provided two sets of gradations, 334 and 336, both at the top and at the bottom of the template sectons. Appropriate pointers 338 and 340 are provided on the second and third template sections 304 and 306 to reference the gradations 334 and 336. A further set of gradations 342 is marked on the bottom portion of the second template section 304, these gradations being referenced by a pointer 344 provided on the first template section 302.

The skirt design aid also has a hip adjusting means, in the form of two members 346 and 348. The member 346 is pivotally attached at its bottom end to the first template section 302 towards its bottom end by a pivot pin 350. At its upper end, the member 346 has a slot 352 which is engaged by the nut and bolt arrangement 310. The member 348 is pivotally attached at its bottom end to the member 346 in the hip region of the skirt, by a pivot pin 354. This member 348 also has a slot 356 which is engaged by the nut and bolt arrangement 310. It will be appreciated that by pivoting the member 346, the member 348 is also displaced, thereby altering the outline of the outer edge 326 and thereby increasing the hip size of the pattern. The extent to which the hip size is increased is indicated by a set of gradations 358 marked on the member 346 which is visible through a window 360 in the member 348 and which are referenced by means of a pointer 362. The nut and bolt arrangement 310 is utilised to release the members 346 and 348 so that they may be adjusted and then secured in the required configuration. A number of apertures 364 is provided in the third template section 306 by means of which styling changes may be effected.

In use, the relative positions of the second and fourth template sections 304 and 308 with respect to the third template section 306 are varied in accordance with the size required, the required size being indicated by the gradations 334 and 336. The gradations 334 are the appropriate gradations if the pattern is to have a dart (utilising the notches 330 and the aperture 332), and the gradations 336 are utilised if the pattern does not have a dart. If the skirt is to be flared, the first template section 302 is pivoted with respect to the second template section 304, the required amount. If a large amount of flaring is required, the fourth template section 308 is also pivoted, the nut and bolt arrangement 320 then sliding in the slot 324. Further, if the skirt is to have pleats, whether of the knife or box type, the fourth template section 308 is accordingly extended.

In use, the skirt design aid 300 is extended as required, in accordance with the size and type of skirt desired, then placed on a sheet of paper and its outline drawn on the paper.

I claim:

1. A garment design aid for assisting a person in providing a pattern for a garment, the design aid including a main pattern template defining a hip region of the garment and including a hip adjusting means comprising:

a first member that is pivotally attached at one end to the pattern template member on one side of the hip region, has at its other end a slot-extending circumferentially of said pivotal attachment that will allow movement of said first member across said main pattern template and has a suitably curved side edge;

a second member that is pivotally attached at one end to the first member intermediate the first member's ends adjacent the hip region, has a substantially outwardly extending slot transverse to the slot in said first member and has a suitably curved side edge which cooperates with the side edge of the first member to define a variable hip profile of the garment;

a pin fast with the main pattern template member and extending through the slots in the first and second members such that pivoting of the first member causes the second member to pivot about its attachment to said first member and to slide along said transfer slot in a suitable manner; and a securing means for securing the first and second members in a desired configuration.

* * * * *